US006427601B2

(12) United States Patent
Albrich

(10) Patent No.: US 6,427,601 B2
(45) Date of Patent: Aug. 6, 2002

(54) INSTALLATION FOR CONVEYING PERSONS

(75) Inventor: Reinhard Albrich, Dornbirn (AT)

(73) Assignee: Innova Patent GmbH, Wolfurt (AT)

( * ) Notice: Subject to any disclaimer, the term of this patent is extended or adjusted under 35 U.S.C. 154(b) by 0 days.

(21) Appl. No.: 09/843,579

(22) Filed: Apr. 26, 2001

(30) Foreign Application Priority Data

Jul. 20, 2000 (AT) ..... 1272/00

(51) Int. Cl.[7] ..... B61B 15/00

(52) U.S. Cl. ..... 104/87; 104/28; 104/89; 104/173.1; 104/178; 105/148

(58) Field of Search ..... 104/27, 28, 112, 104/173.1, 173.2, 178, 179, 180, 184, 87, 48, 89; 105/148

(56) References Cited

U.S. PATENT DOCUMENTS 3,048,123 A * 8/1962 Burmeister et al. ..... 104/178
4,050,385 A * 9/1977 Gurr et al. ..... 104/173.2
4,958,574 A * 9/1990 Meindl ..... 104/178
5,873,310 A * 2/1999 Creissels et al. ..... 104/173.2
6,202,563 B1 * 3/2001 Tarassoff et al. ..... 104/178

* cited by examiner

*Primary Examiner*—Mark T. Le
(74) *Attorney, Agent, or Firm*—Laurence A. Greenberg; Werner H. Stemer; Gregory L. Maybeck

(57) ABSTRACT

The installation conveys persons from a valley station to a mountain station and for carries individuals from the mountain station to the valley station via carriages that are guided along a track formed by a running rail. The installation has a cableway system with a haulage cable and transport assemblies that can be coupled thereto and are intended for persons and for conveying devices that convey the carriages from the valley station to the mountain station. The haulage cable is guided over cable-deflecting pulleys in the valley station and in the mountain station. Guide rails are provided in the valley station and in the mountain station along which the conveying devices and transport assemblies, uncoupled from the haulage cable, are guided around the cable-deflecting pulleys with conveying wheels. Bypass rails are connected to the guide rails via diverters both in the valley station and in the mountain station. The bypass rails contain locations respectively for coupling to the conveying devices the carriages which have been fed to the valley station via the running rail and for uncoupling from the conveying devices the carriages located in the mountain station, and for transferring the latter carriages to the running rail (FIG. 1).

9 Claims, 9 Drawing Sheets

INSTALLATION FOR CONVEYING PERSONS

BACKGROUND OF THE INVENTION

FIELD OF THE INVENTION

The present invention relates to an installation for conveying persons from a valley station to a mountain station and for carrying persons down from the mountain station to the valley station by way of carriages which are guided along a track formed by a running rail. The installation has a cableway system with a haulage cable and transport assemblies, such as lift chairs, cabins, or gondolas, which can be coupled to the haulage cable and which are configured for individuals, and conveying means for conveying the carriages from the valley station to the mountain station. The haulage cable is thereby guided over cable-deflecting pulleys in the valley station and in the mountain station. Guide rails are provided in the valley station and in the mountain station along which the conveying means and transport assemblies, uncoupled from the haulage cable, can be guided around the cable-deflecting pulleys via conveying wheels.

Cableway systems which are designed with transport assemblies, such as cabins and chairs, by means of which persons can be conveyed from a valley station to a mountain station are known in the art. In such cableway systems, the transport assemblies can be coupled to the haulage cable, which is moved at a constant speed of, for example, 8 m/sec. In the stations, the transport assemblies can be uncoupled from the haulage cable and are guided through the stations, along guide rails, at a sufficiently low speed to allow the passengers to board and/or to disembark.

Such prior art cableway systems serve exclusively for conveying persons.

International PCT publication WO 98/36811 discloses an installation for moving individuals from a valley station to a mountain station and also from the mountain station to the valley station. The installation for movement into the valley station comprises a running rail, arranged on supports, and carriages, which can be displaced along the running rail and are designed with an arrangement for accommodating at least one individual. The installation for movement into the mountain station comprises a cableway system by means of which the individuals and the carriages are conveyed from the valley station to the mountain station. It is not specified, however, how the installation for carrying the carriages down into the valley station is functionally connected to the cableway system.

Other prior art installations require two separate means, on the one hand, for conveying the individuals from the valley station to the mountain station and, on the other hand, for conveying the carriages from the valley station to the mountain station. As a result of these installations, it is not only the case that high design outlay is required, but also that the installations do not allow optimum utilization taking into account the fact that the requirements for conveying persons, on the one hand, and for conveying carriages, on the other hand, from the valley station to the mountain station may be different and each of the two conveying means can each only perform one specific function.

SUMMARY OF THE INVENTION

It is accordingly an object of the invention to provide an installation for transporting persons, which overcomes the above-mentioned disadvantages of the heretofore-known devices and methods of this general type and which combines with one another an installation for conveying persons to a mountain station and an installation for carrying individuals down from a mountain station to a valley station, such that the design outlay is reduced, and that optimum utilization of the cableway system provided between the valley station and the mountain station is ensured.

With the foregoing and other objects in view there is provided, in accordance with the invention, an installation for conveying persons from a valley station to a mountain station and for carrying persons from the mountain station to the valley station, comprising:

a track formed by a running rail extending between a mountain station and a valley station and carriages configured to be guided along the track for carrying persons from the mountain station to the valley station;

a cableway system having a haulage cable, transport assemblies to be coupled to the haulage cable for conveying persons from the valley station to the mountain station, and conveying devices configured for conveying the carriages from the valley station to the mountain station;

cable-deflecting pulleys guiding and deflecting the haulage cable in the valley station and in the mountain station;

guide rails in the valley station and in the mountain station for receiving conveying wheels and guiding the conveying devices and the transport assemblies, uncoupled from the haulage cable, around the cable-deflecting pulleys;

bypass rails connected to the guide rails via diverters in the valley station and in the mountain station, the bypass rails having defined locations for coupling to the conveying devices the carriages received in the valley station via the running rail and for uncoupling from the conveying devices the carriages in the mountain station, and for transferring the carriages to the running rail.

In other words, the objects of the invention are achieved in that bypass rails are connected to the guide rails via diverters both in the valley station and in the mountain station, the bypass rails containing locations respectively for coupling to the conveying means the carriages which have been fed to the valley station via the running rail and for uncoupling from the conveying means the carriages located in the mountain station, and for transferring the latter carriages to the running rail.

In accordance with an added feature of the invention, the guide rail includes a first diverter in the valley station configured to move the conveying devices for the carriages onto the bypass rail, and the bypass rail includes the location for coupling to the conveying devices the carriages located in the valley station, and wherein a second diverter is configured downstream of the location to move the conveying devices, loaded with the carriages, onto the guide rail.

In accordance with an additional feature of the invention, the guide rail includes a first diverter in the mountain station configured to move the conveying devices loaded with the carriages to the bypass rail, and the bypass rail includes a location for uncoupling the carriages from the conveying devices, whereupon the carriages are feedable to the running rail, and wherein a second diverter is configured downstream of the location for moving empty conveying devices back to the guide rail.

In accordance with another feature of the invention, there is provided a boarding location in the valley station formed with a plateau for facilitating boarding by persons. The plateau is raised by at least 50 cm, and preferably about 1 m, relative to a level defined in a region of the bypass rail at the location for coupling the carriages.

In accordance with again another feature of the invention, there is provided a disembarking location in the mountain station formed with a plateau for facilitating disembarking by persons. The plateau is raised by at least 50 cm, and preferably 1 m, relative to a level defined in the region of the bypass rail at the location for uncoupling the carriages.

In accordance with a further feature of the invention, the conveying devices for the carriages include a gripper system movably disposed counter to a restoring force provided by a spring system and wherein control rails are disposed above the running rail, at the locations for respectively coupling and uncoupling the carriages to and from the conveying devices, the control rails actuating and controlling the gripper system.

In accordance with a concomitant feature of the invention, for the purpose of coupling the conveying devices to the carriages at the location for coupling the conveying devices, the conveying devices are advanced up to the carriages at a higher speed than the carriages, whereupon the carriages are coupled to the conveying devices via the gripper system actuated by the control rails.

As noted, the guide rail is preferably provided, in the valley station, with a first diverter, via which the conveying means (i.e., the conveying devices) for the carriages can be moved onto the bypass rail, the rail contains the location for coupling to the conveying means the carriages located in the valley station, and provided downstream of the location is a second diverter, via which the conveying means loaded with the carriages can be moved onto the guide rail.

Similarly, the guide rail is formed with a first diverter in the mountain station, via which the conveying means (i.e., the conveying devices) loaded with the carriages can be moved onto the bypass rail, the bypass rail containing that location in which the carriages can be uncoupled from the conveying means, whereupon they can be fed to the running rail, and provided downstream of the location is a second diverter, via which the empty conveying means for the carriages can be moved back to the guide rail.

Other features which are considered as characteristic for the invention are set forth in the appended claims.

Although the invention is illustrated and described herein as embodied in an installation for conveying persons, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
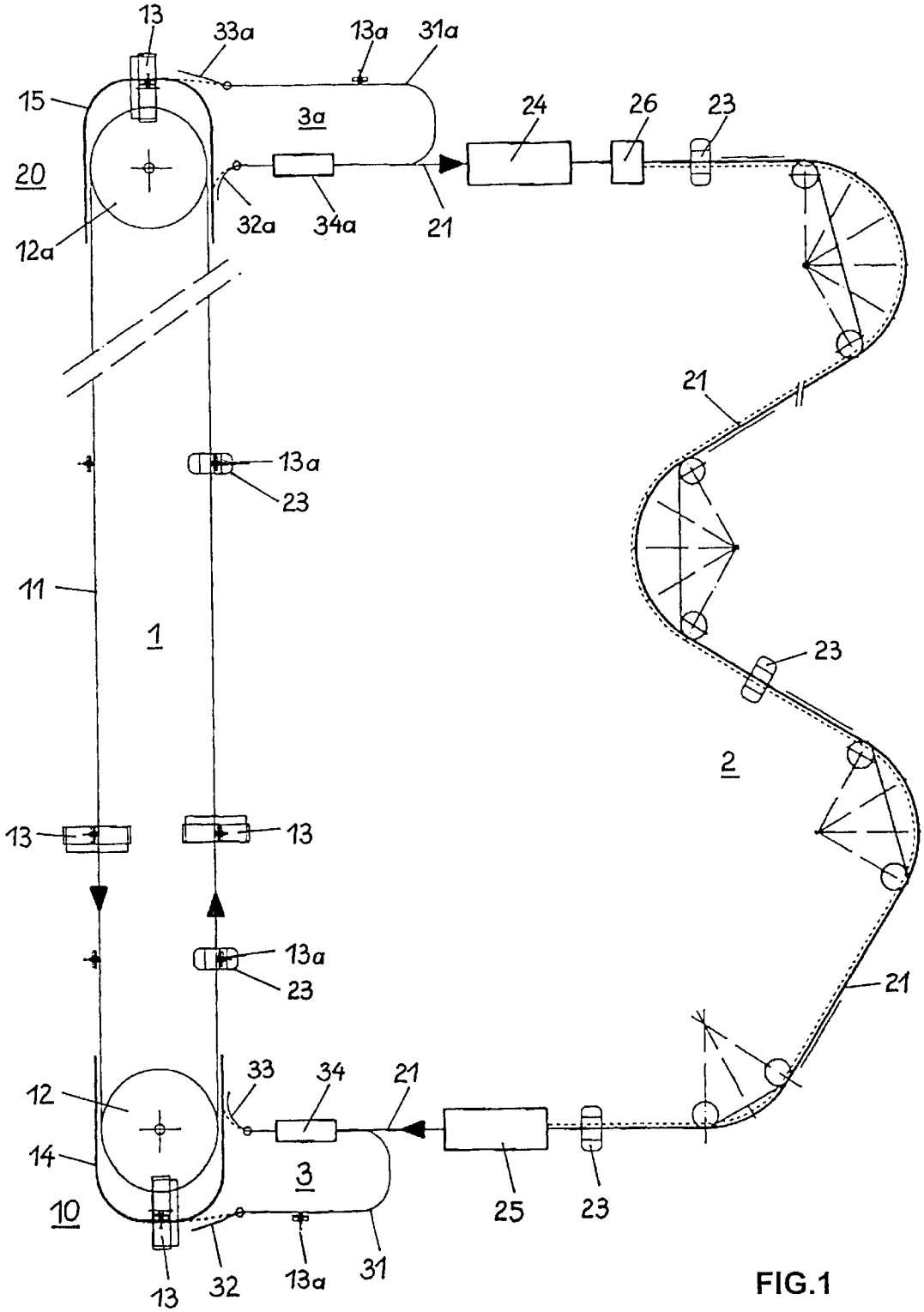
FIG. 1 is a diagrammatic plan view onto an entire installation according to the invention.

Referring now to the figures of the drawing in detail and first, particularly, to FIG. 1 thereof, there is shown the installation for conveying persons from a valley station 10 to a mountain station 20, and for carrying persons down from the mountain station 20 to the valley station 10, by means of carriages 23 which can be moved along a running rail 21. The installation comprises a cableway system 1 and a system 2 for carrying the carriages 23 down along the running rail 21, which runs from the mountain station 20 to the valley station 10.

The cableway system 1, which is designed in a conventional manner, has a haulage cable 11 which is guided over a deflecting pulley 12 in the valley station 10 and over a deflecting pulley 12*a* in the mountain station 10, at least one of the deflecting pulleys being driven. Transport assemblies 13, such as cabins or chairs, can be coupled to the haulage cable 11, which is kept moving at a constant speed of, for example, 8 m/sec, as a result of which they can be moved from the valley station 10 to the mountain station 20. In the two stations 10 and 20, the transport assemblies 13 are uncoupled from the haulage cable 11 and are moved more slowly through the stations, along guide rails 14 and 15, at such a speed that passengers can board and/or disembark from them.

The installation 2 for carrying individuals down from the mountain station 20 to the valley station 10 comprises a track which is located in the terrain that descends from the mountain station 20 to the valley station 10. The track being formed by a cable which is borne by supports and on which the running rail 21, along which the carriages 23 can be moved, is fastened.

A boarding location 24 an d a check-in station 26 are located in the mountain station 20, and a disembarking location 25 is located in the valley station 10.

In order for it also to be possible for the cableway system 1 to be used as a conveying means for the carriages 23, a coupling station 3 is provided in the valley station 10 and an uncoupling station 3*a* is provided in the mountain station 20. The coupling station 3 contains a first bypass rail 31, which can be connected to the guide rail 14 via diverters 32 and 33 and in which a coupling location 34 for coupling the carriages 23 to conveying devices or conveying means 13*a* is located. The uncoupling station 3*a* contains a second bypass rail 31*a,* which can be connected to the guide rail 15 via diverters 32*a* and 33*a* and in which an uncoupling location 34*a* for uncoupling the carriages 23 from the conveying means 13*a,* is located. The conveying means 13*a* for the carriages 23, in the same way as the transport assemblies 13, are defined with a traveling-gear mechanism and with a clamping arrangement for coupling them to the haulage cable 11.

The novel installation operates as follows:

By means of the cableway system 1, the transport assemblies 13 are used in a conventional manner to convey persons from the valley station to the mountain station 20 and from the mountain station 20 to the valley station 10. In addition, in the valley station 10, conveying means 13*a* are moved onto the bypass rail 31 by the diverter 32, empty carriages 23 are coupled thereto in the coupling location 34, the conveying means 13*a* loaded with the carriages 23 are moved into the guide rail 14 via the diverter 33, and the loaded conveying means 13*a,* in the same way as the transport assemblies 13, are accelerated and clamped onto the haulage cable 11, as a result of which they are conveyed to the mountain station 20. In the mountain station 20, the conveying means 13*a* loaded with the carriages 23 are moved onto the bypass rail 31*a* via the diverter 32*a,* the carriages 23 are uncoupled from the conveying means 13*a* in the uncoupling location 34*a,* whereupon they pass to the installation 2, the empty conveying means 13*a* are moved onto the guide rail 15 by the diverter 33*a,* and they are subsequently clamped to the haulage cable 11 again, by means of which they are conveyed to the valley station 10.

The critical features of the installation as a whole are the coupling station 3 and the uncoupling station 3*a,* by means of which the cableway system 1 and the installation 2 for carrying individuals down by means of carriages 23 are functionally interconnected.

Figure 2:
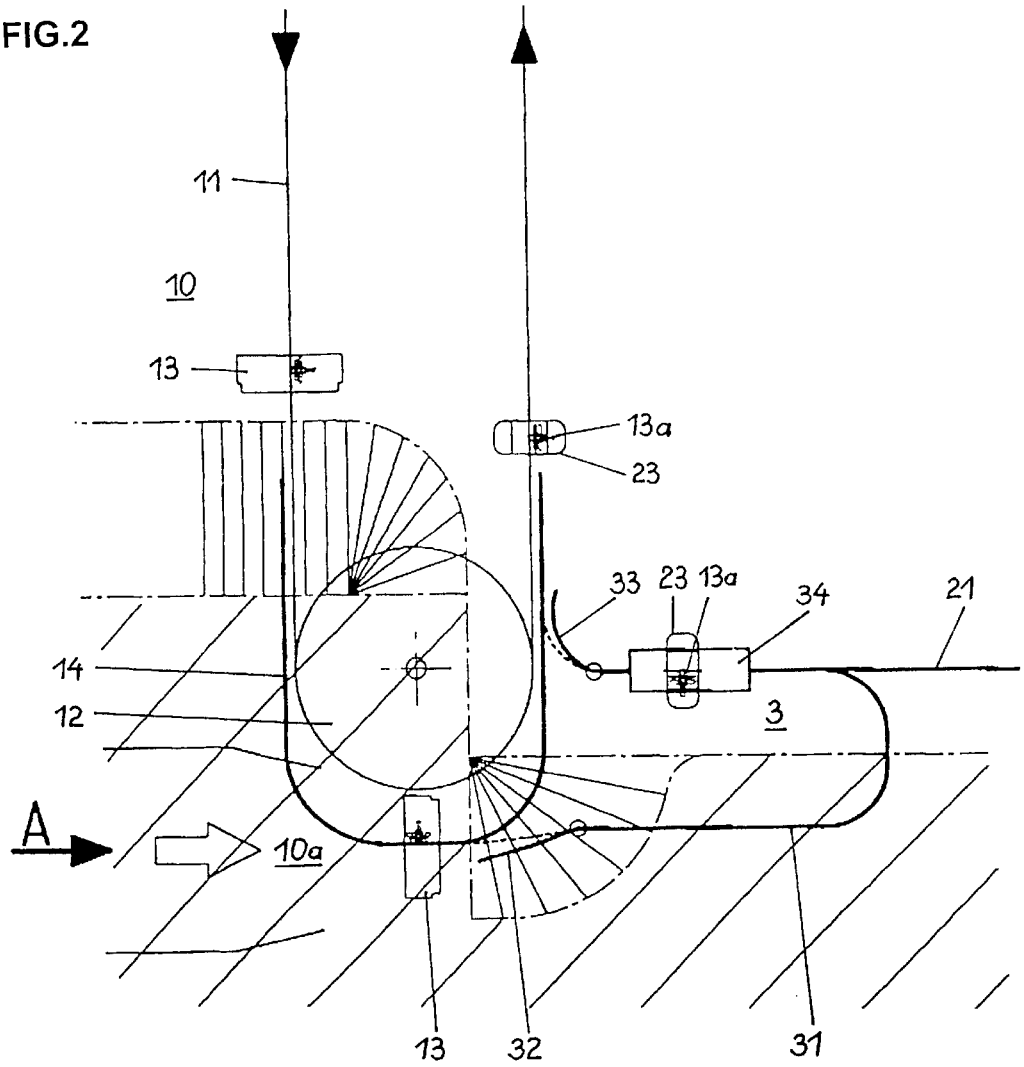
FIG. 2 is a diagrammatic plan view of the valley station of the installation.
Figure 2A:
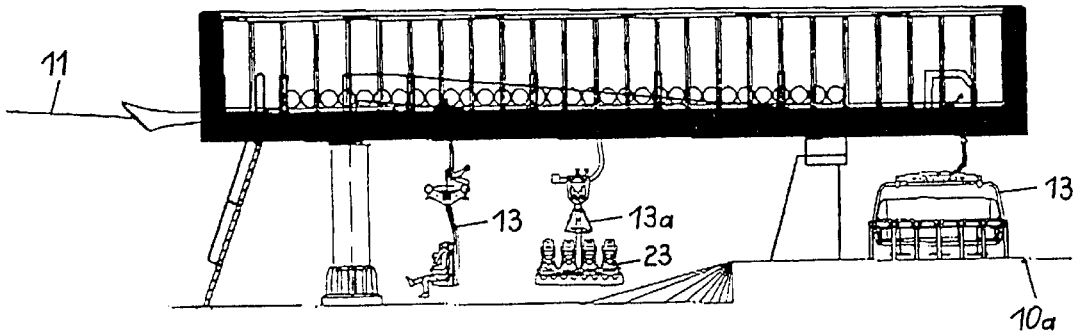
FIG. 2*a* is a side view of the valley station of the novel installation, viewed in the direction of an arrow A in FIG. 2.
Figure 3:
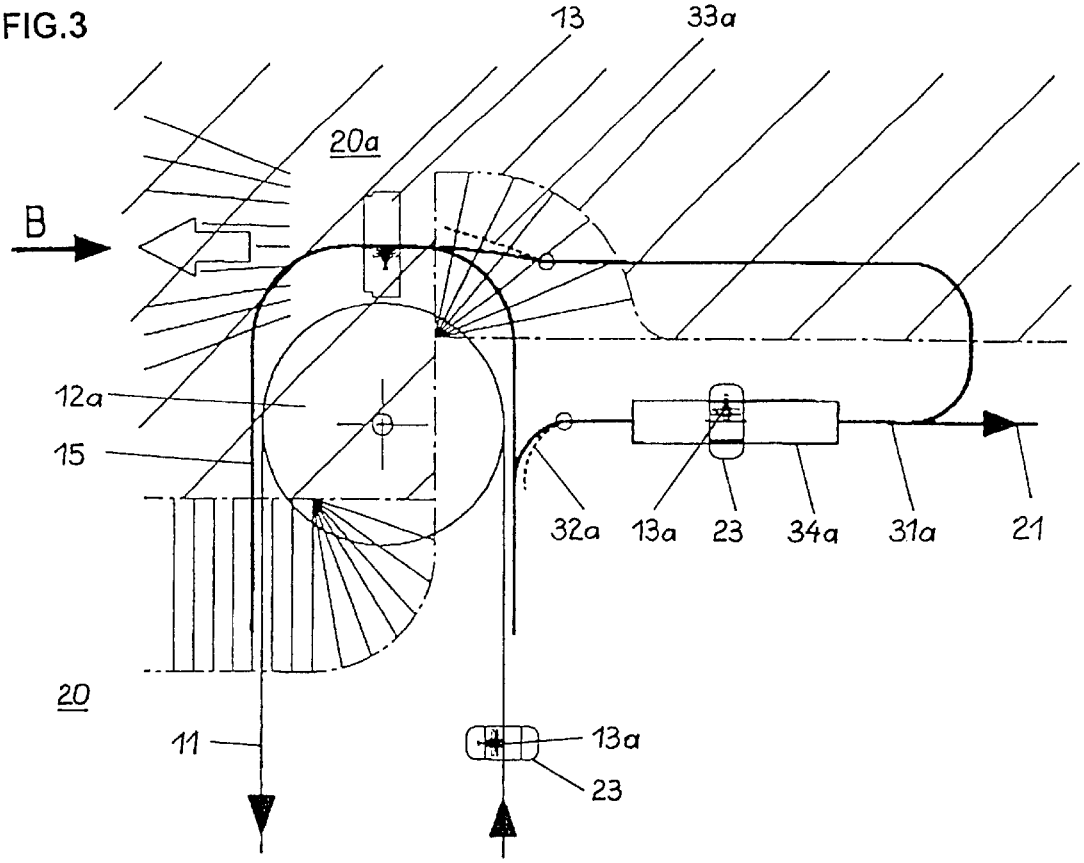
FIG. 3 is a plan view of the mountain station of the installation according to the invention.
Figure 3A:
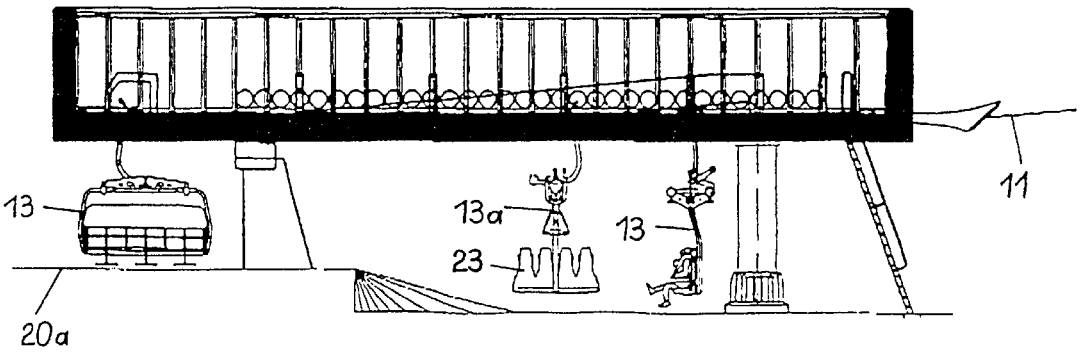
FIG. 3*a* is a side view of the novel mountain station, viewed in the direction of an arrow B in FIG. 3.

The configuration of the valley station 10 will now be explained in the following with reference to FIGS. 2 and 2*a*. It should be noted here that, on the one hand, it has to be possible for the individuals to board and/or to leave the transport assemblies 13, and that, on the other hand, the height of the conveying means 13*a* loaded with the carriages 23 is greater than the height of the transport assemblies 13, for which reason particular importance is attached to the level prevailing in the valley station 10. It is thus necessary to design the boarding and disembarking locations 10*a* as a plateau of which the level is higher by at least 50 cm, preferably by 1 m, than the level in the rest of the valley station 10. These different levels can be gathered from the illustration of FIG. 2*a*. The same also applies to the mountain station 20, in which the disembarking and boarding stations 20*a* are likewise designed as a plateau, of which the level is located at least 50 cm, preferably approximately 1 m, above the level of the rest of the mountain station 10, as can be seen from FIGS. 3 and 3*a*.

Figure 4:
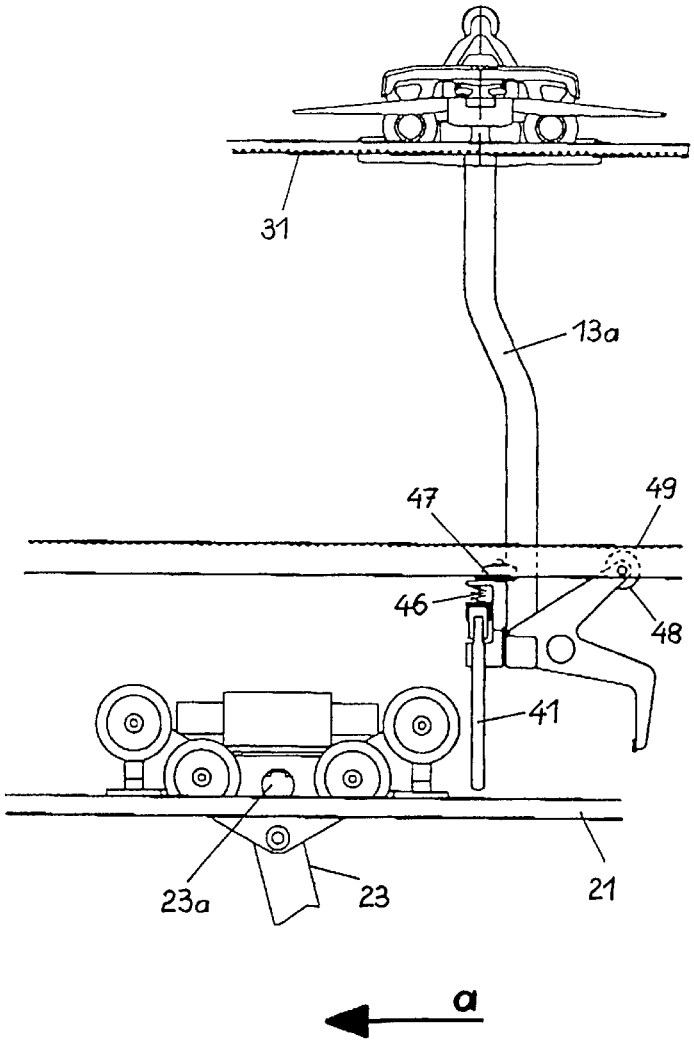
FIGS. 4 and 4*a,* 5 and 5*a,* and 6 and 6*a* are respective side views and end views illustrating the operation, taking place in the valley station, for coupling the carriages to the conveying means for the carriages in order for the latter to be conveyed from the valley station to the mountain station.
Figure 4A:
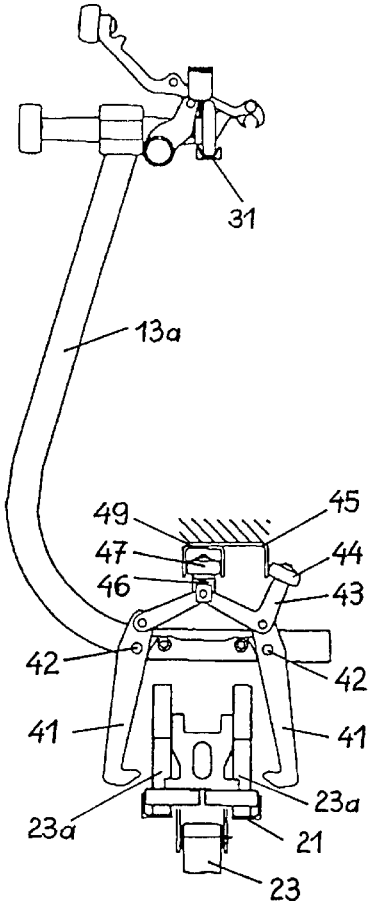

The operation, taking place in the coupling location 34, of coupling a carriage 23 to a conveying means 13*a* is explained hereinbelow with reference to FIGS. 4, 4*a,* 5, 5*a* and 6, 6*a*. As can be seen from FIGS. 4 and 4*a,* a conveying means 13*a* moved along the bypass rail 31 is fed from behind to a carriage 23 moving at the valley-side end of the guide rail 21. At its bottom end, the conveying means 13*a* are designed with two coupling hooks 41 which are pivotally mounted about bolts 42 and, prior to the coupling operation, are kept in the open position, counter to the action of an adjusting spring 46, by means of a control lever 43. For this purpose, the adjusting lever 43 is designed, at its free end, with an adjusting roller 44 which is guided along a control rail 45. In addition, the conveying means 13*a* is designed with rollers 47 and 48 which are guided in a guide rail 49. The conveying means 13*a* is advanced up to the carriage 23, in the direction of the arrow a, at a speed which is somewhat higher than that of the carriage 23. With the coupling, the carriage 23 is designed, on its two side surfaces, with coupling openings 23*a* assigned to the coupling hooks 41.

Figure 5:
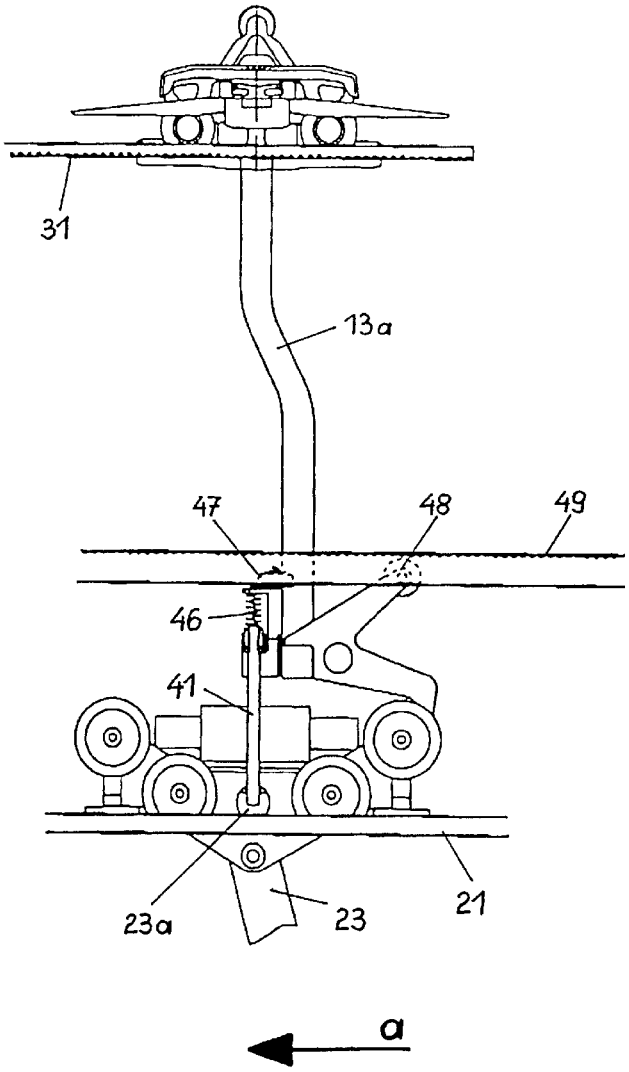
Figure 5A:
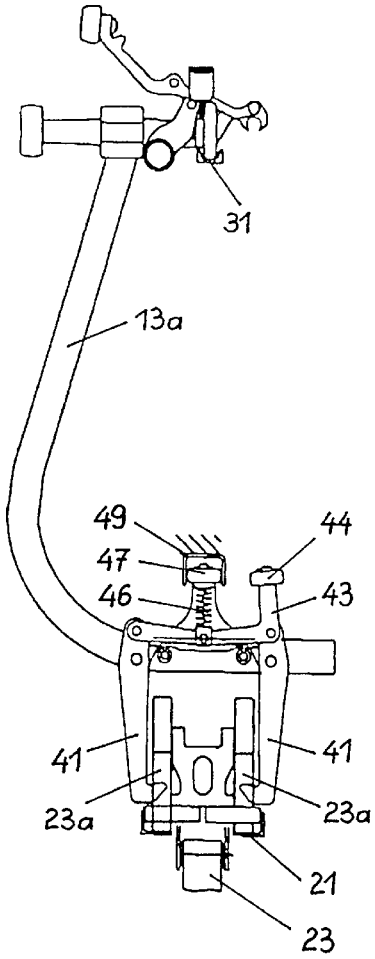

In that region in which the carriage 23 and the conveying means 13*a* are located vertically one above the other, as a result of which the coupling hooks 41 are located outside the coupling openings 23*a,* the control rail 45 terminates, as a result of which the coupling hooks 41 are pivoted in relation to one another, under the action of the adjusting spring 46, and latch into the coupling openings 23*a*. The carriage 23 is thus coupled to the conveying means 13, for which reason you are referred to FIGS. 5 and 5*a*.

Figure 6:
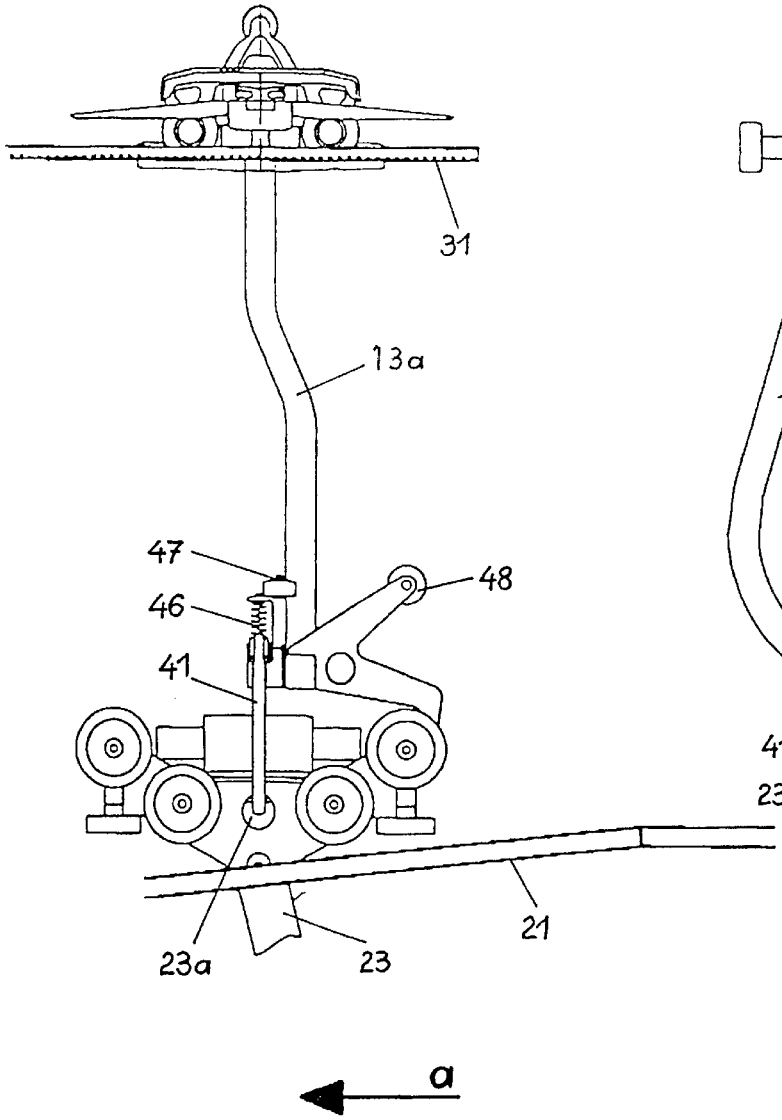
Figure 6A:
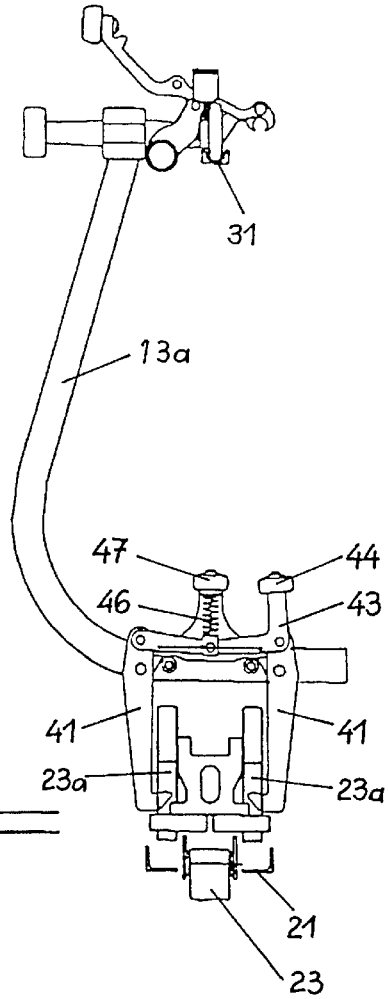

As can additionally be seen from FIGS. 6 and 6*a,* the carriage 23 moving in the direction of the arrow a is then raised from the guide rail 21, whereupon it is fed to the guide rail 14, via the diverter 33, by the conveying means 13*a*. In said guide rail, in the same way as the transport assemblies 13, it is accelerated and subsequently coupled to the haulage cable 11, by means of which it is moved into the mountain station 20.

Figure 7:
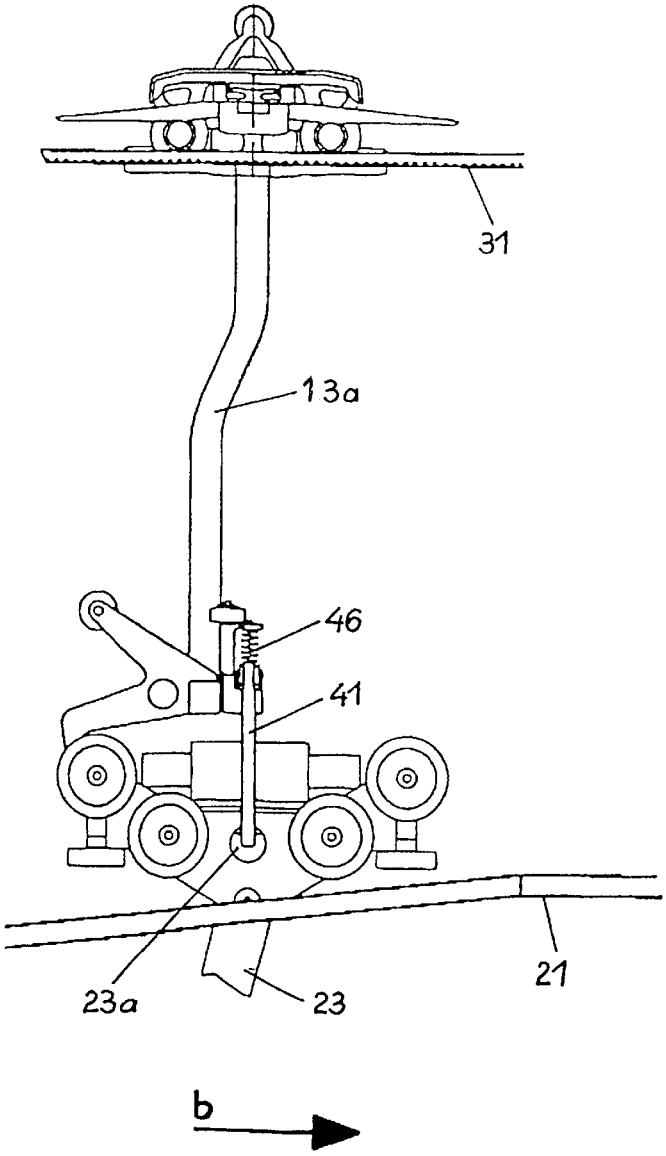
FIGS. 7 and 7*a,* 8 and 8*a,* and 9 and 9*a* are respective side views and end views illustrating the operation, taking place in the mountain station, for uncoupling the carriages from the conveying means.
Figure 7A:
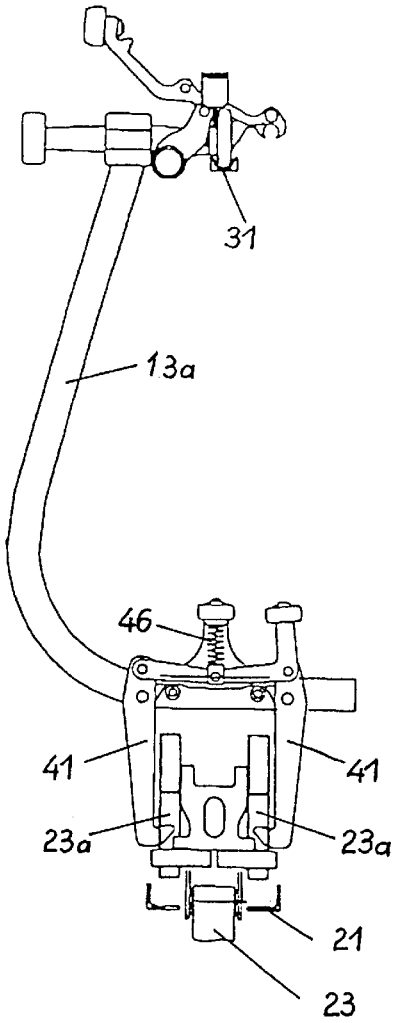
Figure 8:
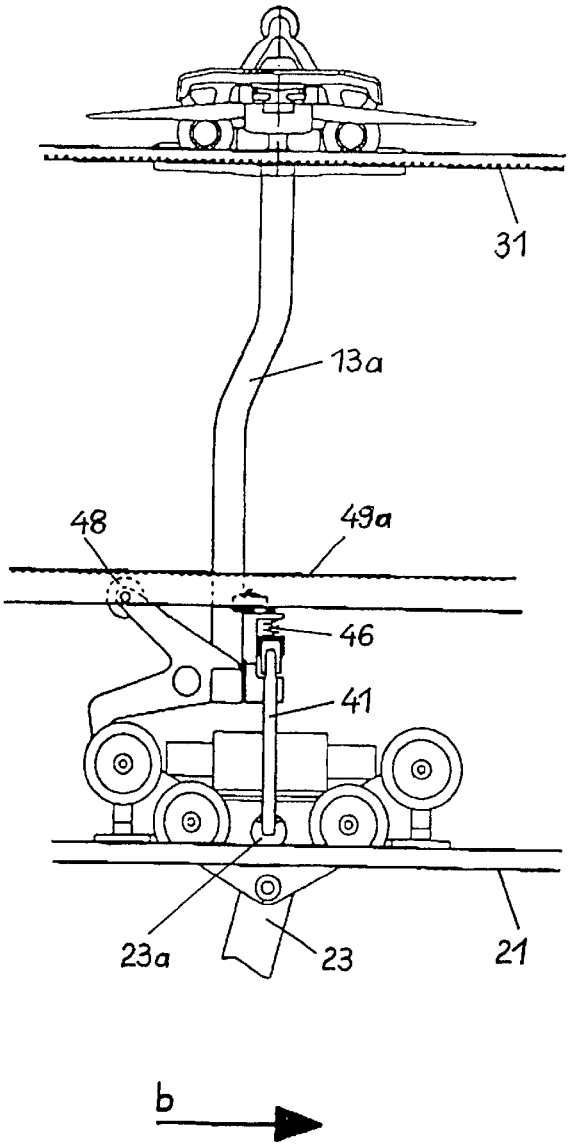
Figure 8A:
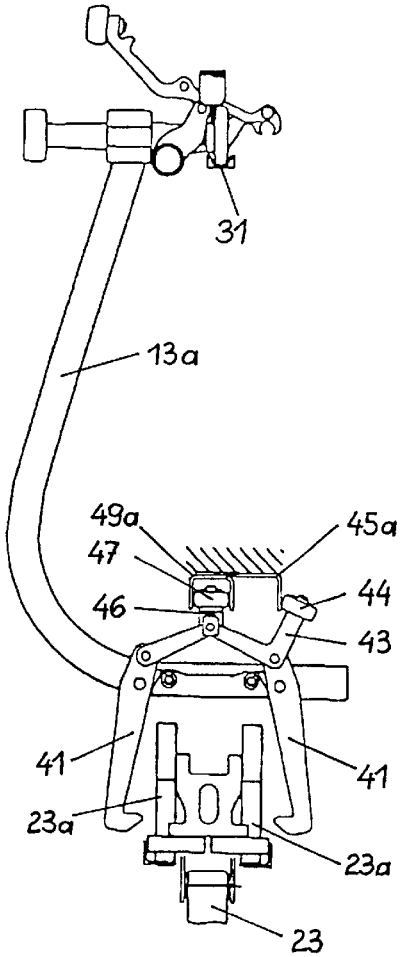
Figure 9:
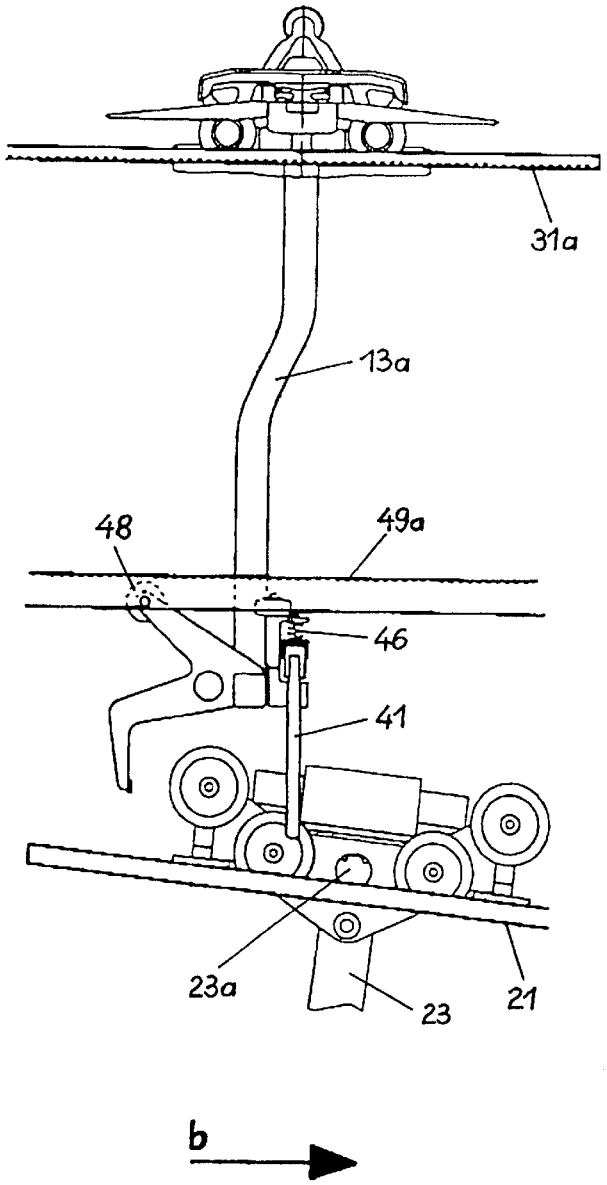
Figure 9A:
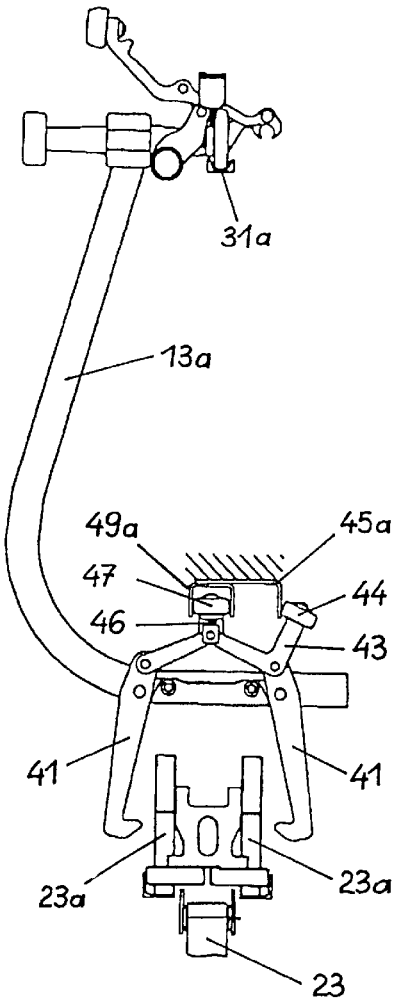

FIGS. 7, 7*a,* 8, 8*a* and 9, 9*a* illustrate the uncoupling operation taking place in the mountain station 20. The carriage coupled to the conveying means 13*a* passes into the region of the running rail 21 in the direction of the arrow b. As soon as the carriage 23 has run onto said running rail, the coupling hooks 41 are pivoted apart from one another, counter to the action of the adjusting spring 46, by a control rail 45*a,* as a result of which they pass out of the latching openings 23*a*. The transport assemblies 13*a* is guided by means of a control rail 49*a*. The carriage 23 subsequently descends via the running rail 21, whereas the conveying means 13*a* is moved along the bypass rail 31*a,* via the diverter 33*a,* to the guide rail 15, along which it is accelerated and then clamped to the haulage cable 11.

I claim:

1. An installation for conveying persons from a valley station to a mountain station and for carrying persons from the mountain station to the valley station, comprising:

a track formed by a running rail extending between a mountain station and a valley station and carriages configured to be guided along said track for carrying persons from the mountain station to the valley station;

a cableway system having a haulage cable, transport assemblies to be coupled to said haulage cable for conveying persons from the valley station to the mountain station, and conveying devices configured for conveying said carriages from the valley station to the mountain station;

cable-deflecting pulleys guiding and deflecting said haulage cable in the valley station and in the mountain station;

guide rails in the valley station and in the mountain station for receiving conveying wheels and guiding said conveying devices and said transport assemblies, uncoupled from said haulage cable, around said cable-deflecting pulleys;

bypass rails connected to said guide rails via diverters in the valley station and in the mountain station, said bypass rails having defined locations for coupling to said conveying devices said carriages received in the valley station via said running rail and for uncoupling from said conveying devices said carriages in said mountain station, and for transferring said carriages to said running rail.

2. The installation according to claim 1, wherein said guide rail includes a first diverter in the valley station configured to move said conveying devices for said carriages onto said bypass rail, and said bypass rail includes said location for coupling to said conveying devices said carriages located in the valley station, and wherein a second diverter is configured downstream of said location to move said conveying devices, loaded with said carriages, onto said guide rail.

3. The installation according to claim 1, wherein said guide rail includes a first diverter in the mountain station configured to move said conveying devices loaded with said carriages to said bypass rail, and said bypass rail includes a location for uncoupling said carriages from said conveying devices, whereupon said carriages are feedable to said running rail, and wherein a second diverter is configured downstream of said location for moving empty conveying devices back to said guide rail.

4. The installation according to claim 1, which comprises a boarding location in the valley station formed with a plateau for facilitating boarding by persons, wherein said plateau is raised by at least 50 cm relative to a level defined in a region of said bypass rail at said location for coupling said carriages.

5. The installation according to claim 1, which comprises a boarding location in the valley station formed with a plateau for facilitating boarding by persons, wherein said plateau is raised by at least 1 m relative to a level defined in a region of said bypass rail at said location for coupling said carriages.

6. The installation according to claim 1, which comprises a disembarking location in the mountain station formed with a plateau for facilitating disembarking by persons, wherein said plateau is raised by at least 50 cm relative to a level defined in the region of said bypass rail at said location for uncoupling said carriages.

7. The installation according to claim 1, which comprises a disembarking location in the mountain station formed with a plateau for facilitating disembarking by persons, wherein said plateau is raised by at least 1 m relative to a level defined in the region of said bypass rail at said location for uncoupling said carriages.

8. The installation according to claim 1, wherein said conveying devices for said carriages include a gripper system movably disposed counter to a restoring force and wherein control rails are disposed above said running rail, at said locations for respectively coupling and uncoupling said carriages to and from said conveying devices, said control rails actuating and controlling said gripper system.

9. The installation according to claim 8, wherein, for coupling said conveying devices to said carriages at said location for coupling said conveying devices, said conveying devices are advanced up to said carriages at a higher speed than said carriages, whereupon said carriages are coupled to said conveying devices via said gripper system actuated by said control rails.

* * * * *